US007568939B2

(12) United States Patent
Diekmann

(10) Patent No.: US 7,568,939 B2
(45) Date of Patent: Aug. 4, 2009

(54) CONNECTING SYSTEM WITH DIRECT PLUG CONNECTION

(75) Inventor: Torsten Diekmann, Leopoldshohe (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/229,654

(22) Filed: Aug. 26, 2008

(65) Prior Publication Data

US 2009/0061669 A1 Mar. 5, 2009

(51) Int. Cl.
*H01R 4/24* (2006.01)

(52) U.S. Cl. ..... 439/438

(58) Field of Classification Search ..... 439/188–189, 439/395, 709, 409, 417, 716, 406, 532, 441, 439/835, 833, 828, 436, 438, 692–695, 852, 439/834

See application file for complete search history.

(56) References Cited

U.S. PATENT DOCUMENTS

| | | | | |
|---|---|---|---|---|
| 4,585,902 | A | 4/1986 | Munroe | |
| 6,280,233 | B1 | 8/2001 | Beege | |
| 6,350,162 | B1 | 2/2002 | Despang | |
| 6,796,855 | B2 | 9/2004 | Fricke | |
| 6,893,286 | B2 | 5/2005 | Drewes | |
| 7,232,324 | B2 | 6/2007 | Oesterhaus | |
| 7,238,043 | B2 * | 7/2007 | Reibke et al. | 439/441 |
| 7,244,140 | B2 * | 7/2007 | Edenharter | 439/441 |
| 7,249,963 | B2 * | 7/2007 | Ramm | 439/437 |
| 7,287,999 | B2 | 10/2007 | Holterhoff | |

FOREIGN PATENT DOCUMENTS

| | | |
|---|---|---|
| DE | 18 29 453 U | 4/1961 |
| DE | 209 321 A1 | 4/1984 |
| DE | 295 12 567 U1 | 10/1995 |
| DE | 203 13 855 U1 | 1/2005 |
| DE | 10 2004 046471 B3 | 2/2006 |

* cited by examiner

*Primary Examiner*—Edwin A. Leon
(74) *Attorney, Agent, or Firm*—Lawrence E. Laubscher, Sr.; Lawrence E. Laubscher, Jr.

(57) ABSTRACT

A plug-in connector arrangement includes a terminal block containing a chamber in which are mounted a horizontal bus bar having a transverse wall, and a resilient contact having a fixed horizontal leg portion, an intermediate portion bent upwardly from the first leg portion, and an outwardly biased second leg portion reversely bent back above the first leg portion. The second leg portion contains a clamping end portion that extends through a conductor opening contained in the first leg portion. The clamping portion includes at least two discrete clamping surfaces so arranged that when a bare conductor is inserted into the conductor opening, the conductor circumferential surface is selectively engaged by one or more of the clamping surfaces in accordance with the diametrical size of the conductor. The conductor is biased by the clamping portion toward electrical engagement with the bus bar transverse wall.

10 Claims, 6 Drawing Sheets

CONNECTING SYSTEM WITH DIRECT PLUG CONNECTION

BACKGROUND OF THE INVENTION

1. Field of the Invention

A plug-in connector arrangement includes a terminal block containing a chamber in which are mounted a horizontal bus bar having a transverse wall, and a resilient contact having a fixed horizontal leg portion, an intermediate portion bent upwardly from the first leg portion, and an outwardly biased second leg portion reversely bent back above the first leg portion. The second leg portion contains a clamping end portion that extends through a conductor opening contained in the first leg portion. The clamping portion includes at least two discrete clamping surfaces so arranged that when a bare conductor is inserted into the conductor opening, the conductor circumferential surface is selectively engaged by one or more of the clamping surfaces in accordance with the diametrical size of the conductor. The conductor is biased by the clamping portion toward electrical engagement with the bus bar transverse wall.

2. Description of Related Art

Plug-in connectors including resilient contact members are well known in the patented prior art, as evidenced, for example, by the U.S. patents to Drews et al U.S. Pat. No. 6,893,286, Beege et al U.S. Pat. No. 6,280,233, Despang U.S. Pat. No. 6,350,162, Fricke et al U.S. Pat. No. 6,796,855, Oesterhaus U.S. Pat. No. 7,232,324, and Holterhoff et al U.S. Pat. No. 7,287,999.

Generally, these resilient contact members include a free clamping leg that press a conductor toward electrical engagement with a bus bar. According to one particular design, there is formed between the free clamping leg of the pressure spring and the bus bar in the contacted state a kind of V at whose tip the conductor is clamped firmly between the bus bar and the free end of the clamping leg, thereby to obtain the electrical contact. It is also known that one can bend the free end of the clamping leg around against the plug-in direction of the conductor in order to make sure that the clamping leg will rest in a linear manner upon the edge of the conductor so as to increase the resistance against any unintentional loosening of the conductor out of the clamping point.

As a rule, the area of the conductors to be contacted is limited, especially when the clamping leg can be swung around only by a small angle due to the geometric conditions. The maximum swing angle, as a rule, then also determines the maximum possible diameter that the conductors, which have to be contacted, can have. This entails the disadvantage that, for example, conducting pins having a greater diameter are not contactable.

The present invention was developed to avoid the above and other drawbacks of the known plug-in type of electrical connector.

SUMMARY OF THE INVENTION

According to a primary object of the present invention, a plug-in connector is provided wherein the resilient contact having a clamping portion includes at least two distinct clamping surfaces for selectively engaging the outer circumferential surface of the conductor in accordance with the diametric size thereof. This makes it possible to use the clamping surfaces selectively in order to contact both conductors that have a smaller diameter as well as conductors having a larger diameter, since each of the two clamping pressure areas is activated only in connection with conductors having different diameters.

This can be done especially in the following manner: One of the two pressure areas is constituted by the free end of the clamping leg, and additional pressure areas, in addition to the two pressure areas, are formed by a first bending area in the clamping leg.

Preferably, along with the first bending area, there is furthermore made an additional oppositely aligned bending area in the clamping leg so that the two bending areas together form a kind of S curve, as a result of which, conductors with a particularly large diameter can also be contacted in the clamping point.

The above features can be implemented especially—but not only—in a particularly advantageous manner when one uses pressure springs with a loop-like structure and a relatively long free clamping leg. It is also conceivable that the pressure spring is generally V-shaped with a first fixed leg and a free clamping leg that then adjoins the first leg.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
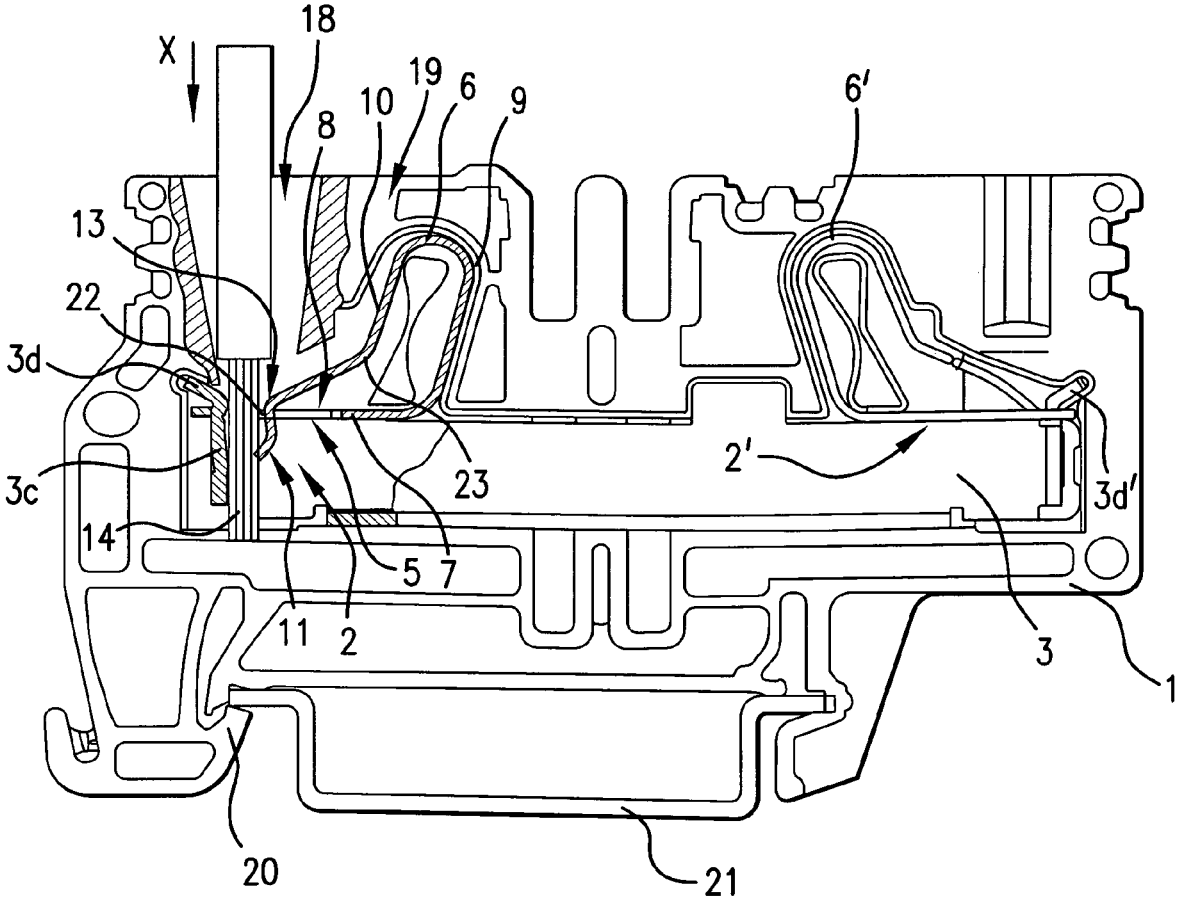
FIGS. 1-3 are a partly sectioned side elevation views of a terminal block of the present invention connected with the bare conductive portions of insulated conductors having small, medium and large diameters, respectively.
Figure 4:
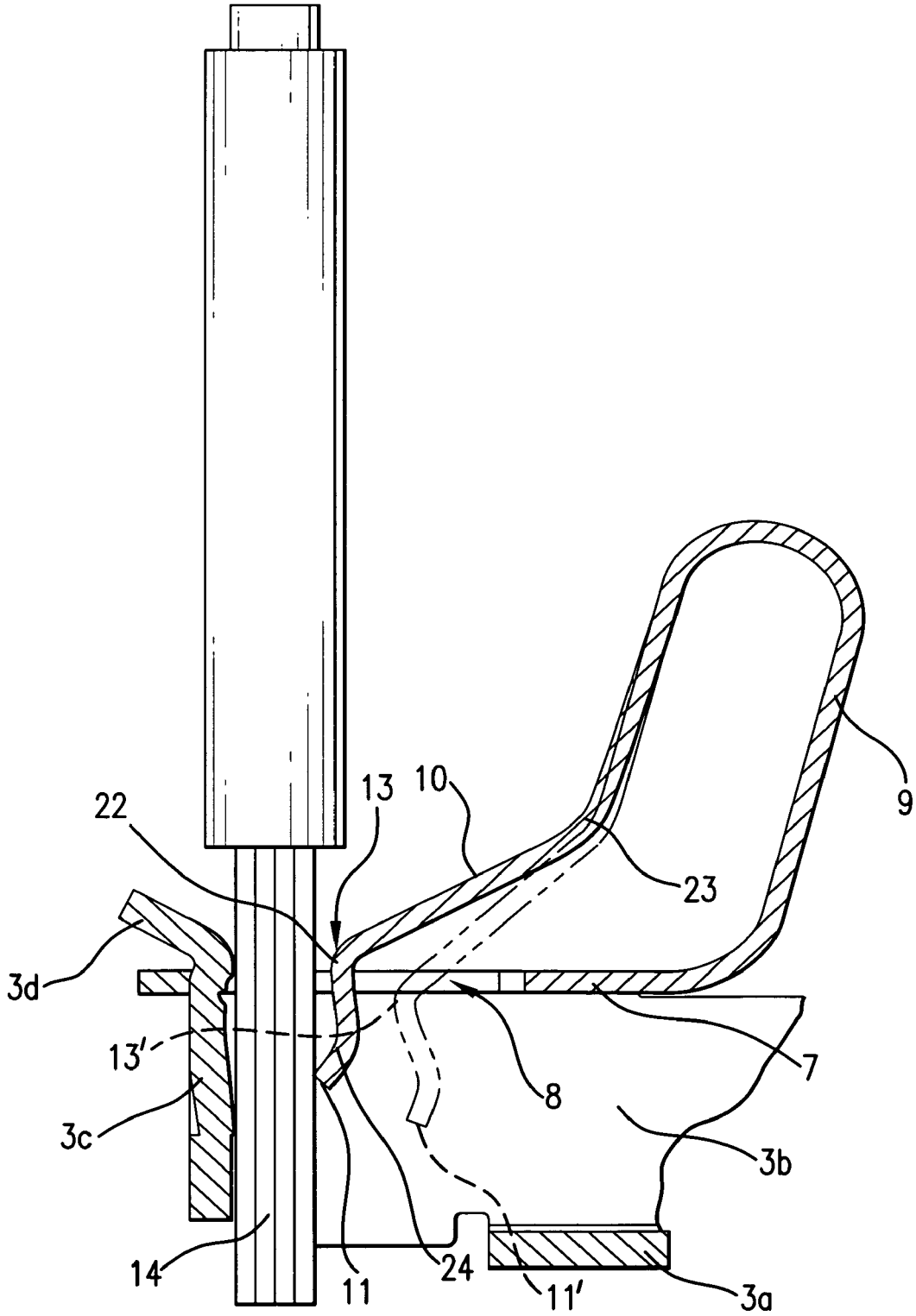
FIGS. 4-6 are detailed views illustrating the clamping engagement of the resilient contact of the present invention with the conductors of FIGS. 1-3, respectively.

Referring first more particularly to FIGS. 1 and 4, the connector arrangement of the present invention includes a terminal block 1 formed from an electrically insulating synthetic plastic material containing cavities that receive a pair of connector devices 2, 2' for electrically connecting the bare ends of a pair of insulated conductors with a horizontal bus bar 3 mounted in a corresponding chamber defined within the terminal block. The bus bar has a generally U-shaped configuration and includes a horizontal bottom wall 3*a*, a pair of parallel spaced vertical side walls 3*b*, and a pair of vertical transverse end walls 3*c* each of which is integrally connected with and bent orthogonally from one of the side and bottom walls, respectively. Two resilient contacts 6, 6' are mounted in cavities provided in the terminal block, each resilient contact including a fixed horizontal leg portion 7 that is seated transversely upon the upper edges of the bus bar side walls 3*b*. Normally, the resilient contacts are formed from an electrically conductive metal material.

The fixed first leg portion 7 contains in the area between the bus bar side walls a conductor opening 8 that receives an integral outwardly flared tab portion 3*d* of the bus bar transverse end wall 3*c*. An integral intermediate portion 9 of the resilient contact 6 is bent upwardly at an obtuse angle from one end of the first leg portion 7, and a movable integral second leg portion 10 is reversely bent back from the upper end of the intermediate resilient contact portion through an angle of about 220°, thereby to extend back over the first leg portion. The second leg portion 10 terminates at its free end in a clamping portion that extends into the conductor opening 8 and is configured to define a pair of clamping surfaces 11 and 13. More particularly, the resilient contact second leg portion contains a convex first bend 22 that defines the clamping surface 13, a concave second bend 23 between the first bend and the intermediate portion 9, and a concave third bend 24 between the first bend and the free end edge of the second leg, whereby said free end edge defines the clamping surface 11.

The conductor opening 8 in the resilient contact fixed first leg portion 7 is arranged opposite the inlet opening 18 contained in the upper portion of the terminal block, whereby when the bare end of an insulated conductor 14 of a given first diameter is introduced downwardly into the chamber, the outwardly flared bus bar tab portion 3*d* will guide the conductor bare end into the conductor opening 8 between the bus bar transverse wall 3*c* and the clamping end portion of the resilient contact 6. The movable second leg portion 10 is biased outwardly, whereby the clamping surface 11 engages the outer circumferential surface of the conductor 14, thereby to displace the conductor bare end into electrical engagement with the bus bar transverse wall 3*c*. The construction and operation of the second resilient contact 6' is the same at the other end of the bus bar.

As shown in FIG. 4, the diameter of the bare end of the conductor 14 is such that only the clamping contact edge 11 is in engagement with the circumferential surface of the conductor. To disengage the clamping surface 11 from the conductor 14, as is known in the art, the tip of a release tool, such as a screwdriver, is inserted into the release opening 19 contained in the upper portion of the terminal block, thereby to displace the clamping portion of the second leg portion downwardly toward the disengaged position 11' shown in phantom.

Figure 2:
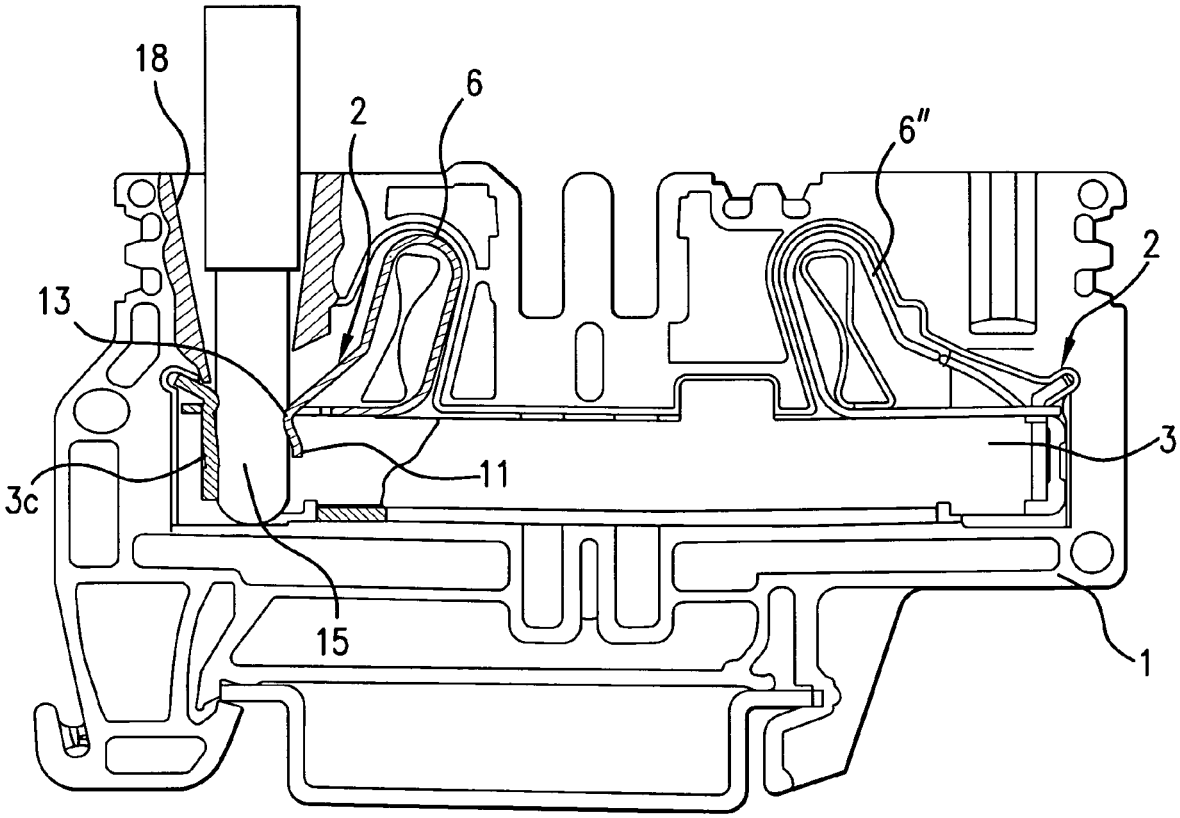
Figure 5:
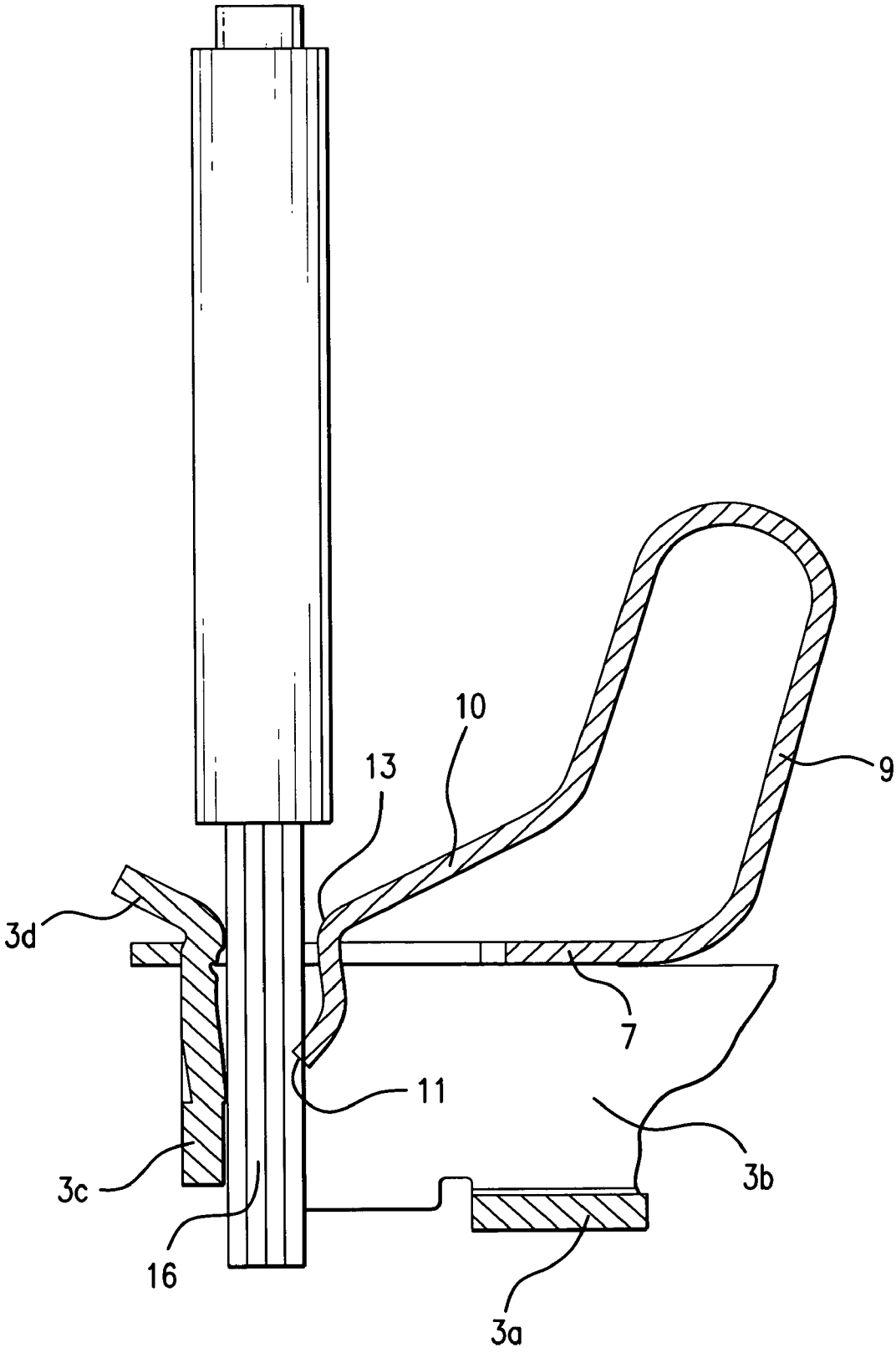
Figure 6:
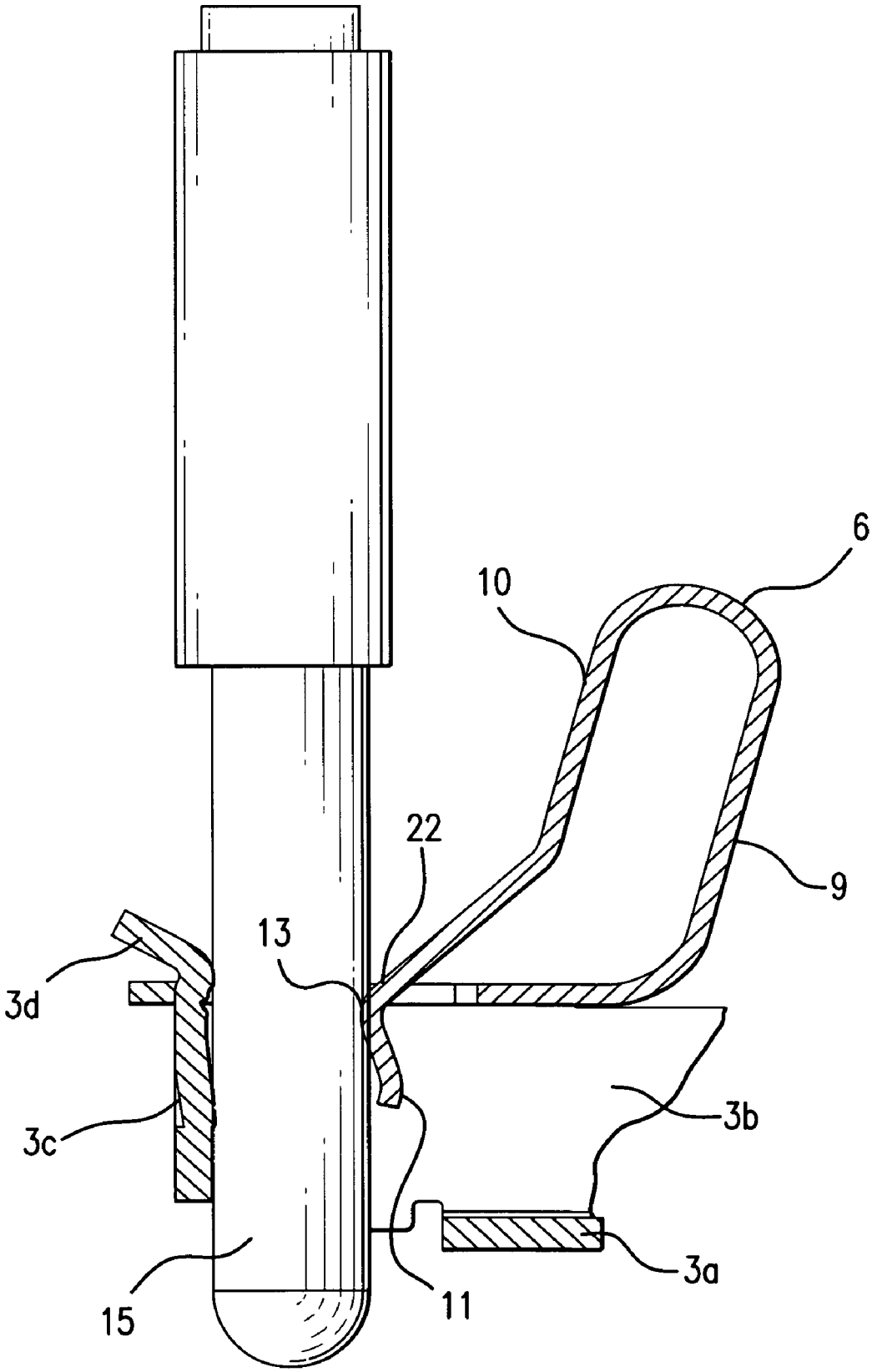

Referring now to FIGS. 2 and 5, when an insulated conductor 15 having a larger diameter is inserted into the bus bar chamber via the inlet opening 18, at least one of the clamping surfaces 11 and 13 is brought into engagement with the outer circumferential surface of the conductor, thereby to bias the conductor 15 toward electrical engagement with the bus bar transverse wall 3*c*. In this case, the edge clamping contact 11 engages the outer circumferential surface of the conductor 15, but in some cases both clamping surfaces 11 and 13 could engage the circumferential surface of the conductor. When an insulated conductor 16 having a still larger diameter is introduced into the bus bar chamber and into the conductor opening 8, only the clamping surface 13 defined by the first bend 22 is in engagement with the outer circumferential surface of the conductor 16.

Figure 3:
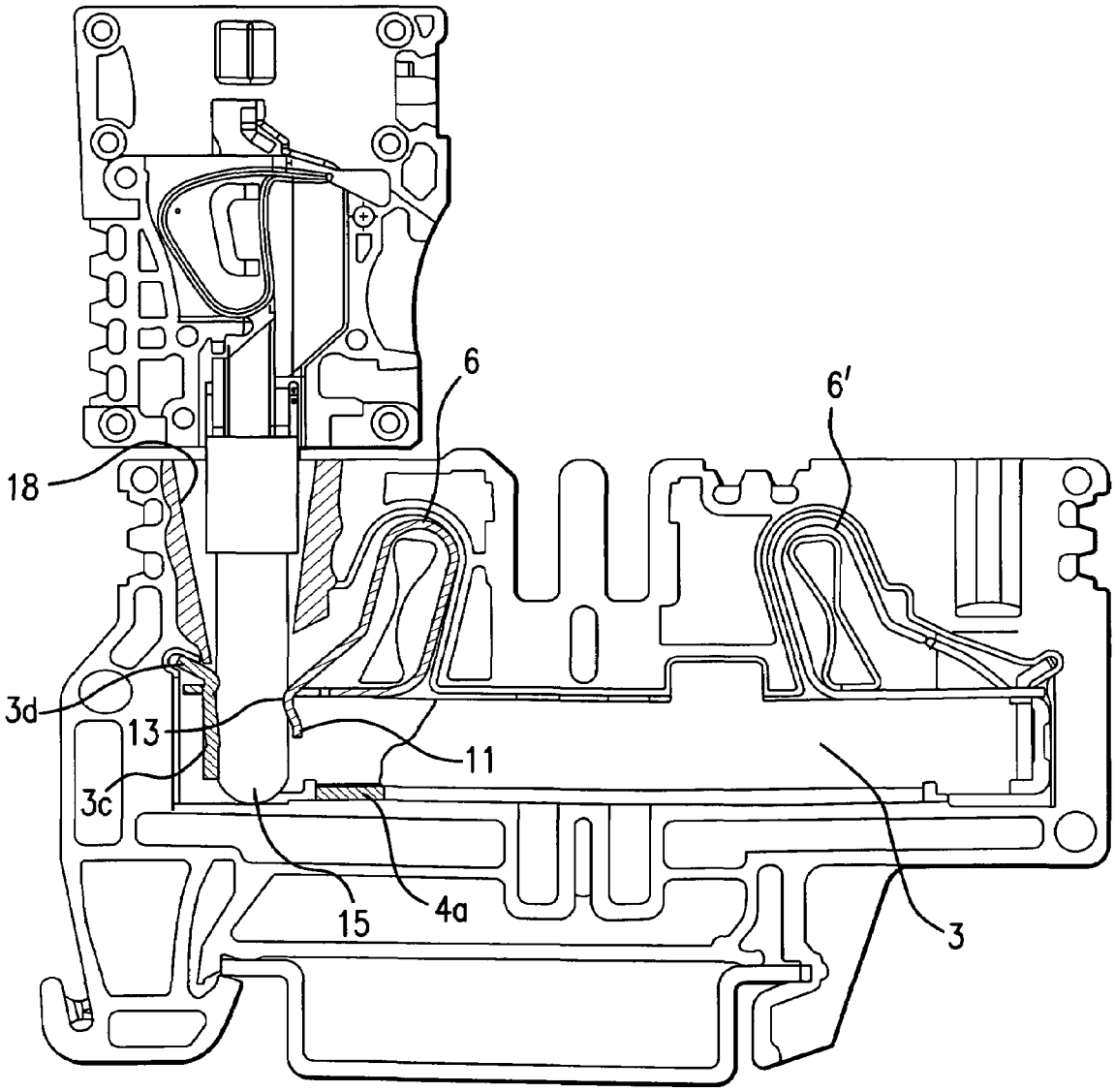

As indicated above, if one inserts a conductor 15 having a greater diameter (FIG. 2), then the forward-arched-convex clamping surface 13 will rest against the conductor. Conductor 15 can especially be a pin-like contact tip of a plug connection 17 (FIG. 2 or 3), which, for example, is used to make a transition to another connection type (in this case, a tension spring), or it can simply be a conductor with a particularly large diameter (FIG. 5). FIG. 4 illustrates the location of the clamping leg 10 by way of example for two conductor diameters.

The diameter area of conductors to be contacted is increased once more in the following manner: Positioned in front of the pressure area 13 or the convex bending area, there is an oppositely aligned additional bending area 23 in the clamping leg 10 so that the two bending areas give the free clamping leg 10 a shape resembling an S curve with a long-drawn-out S-curve geometry. The additional bending area 23 is arranged somewhat in the middle of the free clamping leg 10.

The first bending area, which constitutes the pressure area 13, is now positioned a few mm—less than 10 mm—or just before the free end 10 of the clamping leg.

While in accordance with the provisions of the Patent Statutes the preferred forms and embodiments of the invention have been illustrated and described, it will be apparent to those skilled in the art that changes may be made without deviating from the invention described above.

What is claimed is:

1. A plug-in electrical connector arrangement adapted for connection with one of a plurality of insulated conductors (14-16) having diameters of different sizes, comprising:

(a) a terminal block (1) formed of an electrically-insulating synthetic plastic material, said terminal block containing a chamber, the upper portion of said terminal block containing at least one inlet opening (18) communicating with said chamber;

(b) a bus bar (3) mounted in said chamber, said bus bar including a vertical transverse wall (3*c*) adjacent said conductor opening; and (c) a resilient contact member (6) mounted in said chamber adjacent said inlet opening, said resilient contact member (6) including:

(1) a fixed horizontal generally linear first leg portion (7) adjacent said inlet opening, said first leg portion containing a conductor opening (8) opposite said inlet opening, said bus bar transverse wall having a tab portion (3*d*) extending into said conductor opening;

(2) an intermediate portion (9) bent upwardly at one end of said first leg portion; and (3) a movable second leg portion (10) bent from said intermediate portion to extend over said first leg portion, the free extremity of said second leg portion terminating in a clamping portion that extends into said conductor opening, said second leg portion being resiliently biased outwardly toward said bus bar transverse wall;

(4) said second leg clamping portion having a configuration to define at least two discrete clamping surfaces (11, 13) so arranged that when the bare end of a conductor of one of a number of given diametric sizes is introduced into said bus bar chamber via said inlet opening to a position between said bus bar transverse wall and said second leg clamping portion, the circumferential surface of the conductor is engaged by the corresponding one of said clamping surfaces for displacement of the conductor toward electrical engagement with said transverse bus bar wall.

2. A plug-in electrical connector arrangement as defined in claim 1, wherein said bus bar has a generally U-shaped cross-sectional configuration including a horizontal bottom wall (3*a*), and a pair of parallel spaced vertical side walls (3*b*), said transverse wall being integral with and bent to a position normal to one of said bottom and side walls, said resilient contact fixed leg portion being seated across the upper edges of said side wall with said conductor opening being contained between said side wall upper edges.

3. A plug-in electrical connector arrangement as defined in claim 2, wherein said bus bar includes a plurality of transverse walls, and further wherein said terminal block contains a plurality of resilient contacts (6, 6') arranged for cooperation with said bus bar transverse walls, respectively.

4. A plug-in electrical connector arrangement as defined in claim 2, wherein one of said clamping surfaces comprises the end edge (11) of said second leg portion.

5. A plug-in electrical connector arrangement as defined in claim 4, wherein said second leg portion contains intermediate its ends a convex first bend (22) that defines the other of said clamping surfaces (13) extending in the direction of said bus bar transverse wall.

6. A plug-in electrical connector arrangement as defined in claim 5, wherein said second leg portion contains between said first bend and said resilient contact intermediate portion a concave second bend (23), whereby said first and second bends cooperate to define in said second leg portion a first S-shaped deformation.

7. A plug-in electrical connector arrangement as defined in claim 6, wherein said clamping portion contains between said first bend and said end edge a concave third bend (24), whereby said first and third bends cooperate to define in said second leg portion a second S-shaped deformation.

8. A plug-in electrical connector arrangement as defined in claim 6, wherein the upper portion of said terminal block contains above said resilient contact second leg portion a tool access opening (19), thereby to permit the insertion of the tip of a tool into said chamber to release said clamping leg portion from engagement with the circumferential surface of a conductor introduced into said conductor opening.

9. A plug-in electrical connector arrangement as defined in claim 1, wherein said resilient contact intermediate portion is arranged at an obtuse angle relative to said resilient contact first leg portion.

10. A plug-in electrical connector arrangement as defined in claim 9, wherein said resilient contact second leg portion is bent at an angle of about 220° relative to said resilient contact intermediate portion.

* * * * *